US009330622B2

(12) United States Patent
Hung et al.

(10) Patent No.: US 9,330,622 B2
(45) Date of Patent: May 3, 2016

(54) DISPLAY AND METHOD OF GENERATING AN IMAGE WITH UNIFORM BRIGHTNESS

(71) Applicant: AU Optronics Corp., Hsin-Chu (TW)

(72) Inventors: Yi-Xuan Hung, Hsin-Chu (TW); Yu-Hsin Ting, Hsin-Chu (TW); Chen-Ming Chen, Hsin-Chu (TW); I-Fang Chen, Hsin-Chu (TW); Da-Wei Fan, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 120 days.

(21) Appl. No.: 13/897,451

(22) Filed: May 20, 2013

(65) Prior Publication Data

US 2014/0132651 A1 May 15, 2014

(30) Foreign Application Priority Data

Nov. 14, 2012 (TW) ..... 101142421 A

(51) Int. Cl.
*G09G 3/36* (2006.01)

(52) U.S. Cl.
CPC ..... *G09G 3/3648* (2013.01); *G09G 3/3607* (2013.01); *G09G 2300/0426* (2013.01); *G09G 2300/0452* (2013.01); *G09G 2300/0465* (2013.01); *G09G 2320/0209* (2013.01); *G09G 2320/0233* (2013.01)

(58) Field of Classification Search
CPC ..... G09G 2300/0426; G09G 2300/0452; G09G 2300/0465; G09G 2320/0209; G09G 2320/0233; G09G 3/3607; G09G 3/3648
USPC ..... 345/156–184
See application file for complete search history.

(56) References Cited

U.S. PATENT DOCUMENTS

| | | | | |
|---|---|---|---|---|
| 5,619,225 | A | 4/1997 | Hashimoto | |
| 2010/0182289 | A1 | 7/2010 | Hsu et al. | |
| 2010/0302215 | A1 | 12/2010 | Tsai et al. | |
| 2012/0212401 | A1 * | 8/2012 | Bae et al. | 345/88 |
| 2012/0262431 | A1 | 10/2012 | Cheng et al. | |

FOREIGN PATENT DOCUMENTS

| | | | |
|---|---|---|---|
| CN | 101819366 | A | 9/2010 |

* cited by examiner

*Primary Examiner* — Kumar Patel
*Assistant Examiner* — Insa Sadio
(74) *Attorney, Agent, or Firm* — Winston Hsu; Scott Margo

(57) ABSTRACT

A display includes a plurality of pixels, a plurality of scan lines and a plurality of data lines. Each pixel includes a first color sub-pixel, a second color sub-pixel and a third color sub-pixel. The scan lines and the data lines are coupled to the pixels. Two color sub-pixels in the same row coupled to the same data line are coupled to different scan lines, and all of the second color sub-pixels in the same row are coupled to the same scan line.

16 Claims, 12 Drawing Sheets

DISPLAY AND METHOD OF GENERATING AN IMAGE WITH UNIFORM BRIGHTNESS

BACKGROUND OF THE INVENTION

1. Field of the Invention

The present invention relates to a display, especially a display capable of generating an image with uniform brightness.

2. Description of the Prior Art

Due to their slim shapes, low power consumption and low radiation, liquid crystal displays (LCDs) are widely used nowadays. When driving an LCD, a voltage difference is imposed at both ends of the liquid crystal layer to change the arrangement of liquid crystals so as to change the transmittance rate of the liquid crystal layer and to display an image.

In general, the liquid crystal display comprises a plurality of pixels, a source driver and a gate driver. The gate driver is coupled to the pixels through a plurality of gate lines, and the source driver is coupled to the pixels through a plurality of data lines, so that the gate driver can control the pixels to receive data transmitted from the source driver.

In order to reduce thickness and cost of displays, displays with reduced number of data lines have been developed. Please refer to FIG. 1, which shows a related art display 100. As shown in FIG. 1, the display 100 comprises a plurality of gate lines GL1 to GL4, a plurality of data lines DL1 to DL3 and a plurality of pixels 50. Each of the pixels 50 comprises a red sub-pixel R, a green sub-pixel G and a blue sub-pixel B. Since the number of data line of the display 100 is halved, two adjacent sub-pixels sharing the same data line must be coupled to different scan lines, so as to control the sub-pixels separately. Take the color sub-pixels in the first row for example, the first (left most) red sub-pixel R is coupled to the gate line GL1 and the data line DL1, the first green sub-pixel G next to the first red sub-pixel R is coupled to the gate line GL2 and the data line DL1, the first blue sub-pixel B next to the first green sub-pixel G is coupled to the gate line GL1 and the data line DL2, the second red sub-pixel R next to the first blue sub-pixel B is coupled to the gate line GL2 and the data line DL2, the second green sub-pixel G next to the second red sub-pixel R is coupled to the gate line GL1 and the data line DL3, and the second blue sub-pixel B next to the second green sub-pixel G is coupled to the gate line GL2 and the data line DL3. In such structure, time differences will occur when charging sub-pixels in the same row, because they are coupled to two different gate lines. This causes the levels of the previously charged sub-pixels being affected by the levels of the later charged sub-pixels. Thus, the brightness of the display 100 can not be consistent, and the display will generate the line mura effect.

Please refer to FIG. 2, which shows the waveform of light vision efficiency vs. the wavelength of light. FIG. 2 is depicted based on the International Commission on Illumination (CIE). 250 testers with normal visions are tested to generate the waveform. The waveform shows that the sensitivity of human eyes varies with the wavelength of light. In general, the wavelength of blue light is between 460 nm and 490 nm. The wavelength of green light is between 490 nm and 570 nm. The wavelength of red light is between 630 nm and 750 nm. Thus it can be seen from FIG. 2 that in these three colors, the human eye is very sensitive green light, and least sensitive to blue light.

In the second row of the display 100, the level of the green sub-pixel G coupled to the gate line GL3 and the data line DL2 will be affected by the level of the blue sub-pixel B coupled to the gate line GL4 and the data line DL2, causing the line mura effect. Unfortunately, green is the most sensitive color to human eyes, thus the image quality of the display 100 could be detrimental to users.

SUMMARY OF THE INVENTION

An embodiment of the present invention relates to a display. The display comprises a plurality of pixels, scan lines and data lines. Each of the pixels comprises a first color sub-pixel, a second color sub-pixel and a third color sub-pixel. Two color sub-pixels in a same row coupled to a same data line are coupled to different scan lines, and all of second color sub-pixels in a same row are coupled to a same scan line.

Another embodiment of the present invention relates to a method for driving a display. The display comprises a plurality of pixels, a plurality of scan lines and a plurality of data lines. Each of the pixels comprises a first color sub-pixel, a second color sub-pixel and a third color sub-pixel. Every two color sub-pixels in a same row coupled to a same data line have different colors. The method comprises driving first color sub-pixels and third color sub-pixels in the same row, and driving second color sub-pixels in the same row after driving the first color sub-pixels and the third color sub-pixels in the same row.

These and other objectives of the present invention will no doubt become obvious to those of ordinary skill in the art after reading the following detailed description of the preferred embodiment that is illustrated in the various figures and drawings.

DETAILED DESCRIPTION

Some phrases are referred to specific elements in the present specification and claims, please notice that the manufacturer might use different terms to refer to the same elements. However, the definition between elements is based on their functions instead of their names. Further, in the present specification and claims, the term "comprising" is open type and should not be viewed as the term "consisted of."

The embodiments and figures are provided as follows in order to illustrate the disclosure in detail, but the claimed scope of the disclosure is not limited by the provided embodiments and figures.

Figure 3:
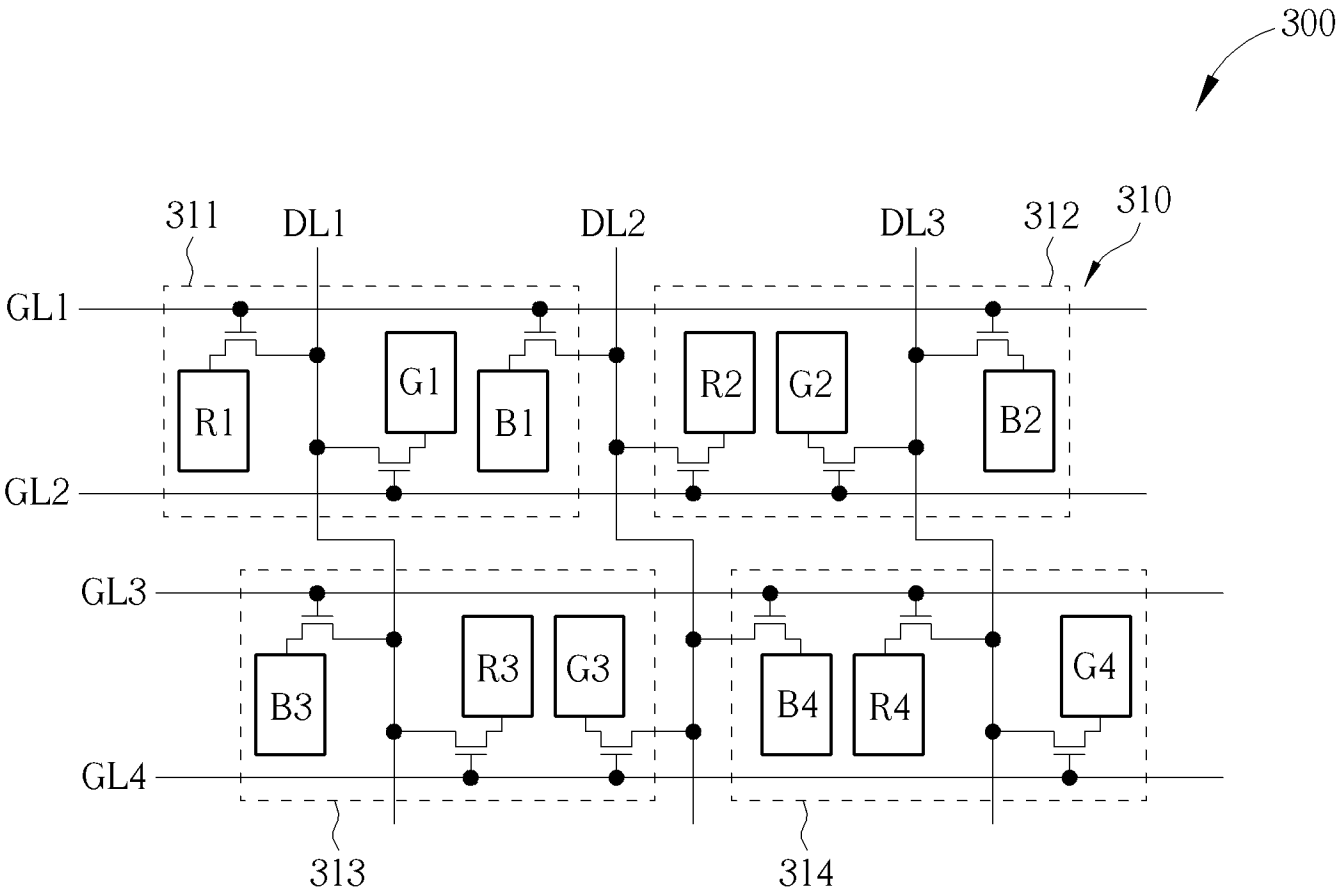
FIG. 3 shows a display according to the first embodiment of the present invention.

Please refer to FIG. 3, which shows a display 300 according to the first embodiment of the present invention. As shown in FIG. 3, the display 300 comprises a plurality of pixels 310, scan lines GL1 to GL4 and data lines DL1 to DL3. Each pixel 310 comprises at least three color sub-pixels, which can be red, green and blue sub-pixels respectively.

The dotted encircled pixels comprise a first pixel 311, a second pixel 312, a third pixel 313 and a fourth pixel 314. The first pixel 311 and the second pixel 312 are configured in the same row, and the third pixel 313 and the fourth pixel 314 are configured in the same row. The first pixel 311 comprises color sub-pixels R1, G1 and B1, the second pixel 312 comprises color sub-pixels R2, G2 and B2, the third pixel 313 comprises color sub-pixels R3, G3 and B3, and the fourth pixel 314 comprises color sub-pixels R4, G4 and B4. The color sub-pixels R1, R2, R3 and R4 can be red color sub-pixels, the color sub-pixels G1, G2, G3 and G4 can be green color sub-pixels, and the color sub-pixels B1, B2, B3 and B4 can be blue color sub-pixels. Moreover, in this and following embodiments, the color sub-pixels R1, R2, R3 and R4 can be called as first color sub-pixels, the color sub-pixels G1, G2, G3 and G4 can be called as second color sub-pixels, and the color sub-pixels B1, B2, B3 and B4 can be called as third color sub-pixels.

The first scan line GL1 to the fourth scan line GL4 and the first data line DL1 to the third data line DL3 are coupled to the pixels 310, and two color sub-pixels in a same row coupled to a same data line are coupled to different scan lines. For example, the color sub-pixels R1 and G1 are coupled to the first data line DL1, but are respectively coupled to the first scan line GL1 and the second scan line GL2. However, the color sub-pixels G1 and G2 are both coupled to the second scan line GL2.

In the structure of FIG. 3, the first color sub-pixel R1 of the first pixel 311 and the second color sub-pixel G1 of the first pixel 311 are coupled to the first data line DL1, the third color sub-pixel B1 of the first pixel 311 and the first color sub-pixel R2 of the second pixel 312 are coupled to the second data line DL2, the second color sub-pixel G2 of the second pixel 312 and the third color sub-pixel B2 of the second pixel 312 are coupled to the third data line DL3, the first color sub-pixel R3 of the third pixel 313 and the third color sub-pixel B3 of the third pixel 313 are coupled to the first data line DL1, the second color sub-pixel G3 of the third pixel 313 and the third color sub-pixel B4 of the fourth pixel 314 are coupled to the second data line DL2, and the first color sub-pixel R4 of the fourth pixel 314 and the second color sub-pixel G4 of the fourth pixel 314 are coupled to the third data line DL3.

The first color sub-pixel R1 of the first pixel 311, the third color sub-pixel B1 of the first pixel 311 and the third color sub-pixel B2 of the second pixel 312 are coupled to the first scan line GL1. The second color sub-pixel G1 of the first pixel 311, the first color sub-pixel R2 of the second pixel 312 and the second color sub-pixel G2 of the second pixel 312 are coupled to the second scan line GL2. The third color sub-pixel B3 of the third pixel 313, the first color sub-pixel R4 of the fourth pixel 314 and the third color sub-pixel B4 of the fourth pixel 314 are coupled to the third scan line GL3. The first color sub-pixel R3 of the third pixel 313, the second color sub-pixel G3 of the third pixel 313 and the second color sub-pixel G4 of the fourth pixel 314 are coupled to the fourth scan line GL4.

Figure 1:
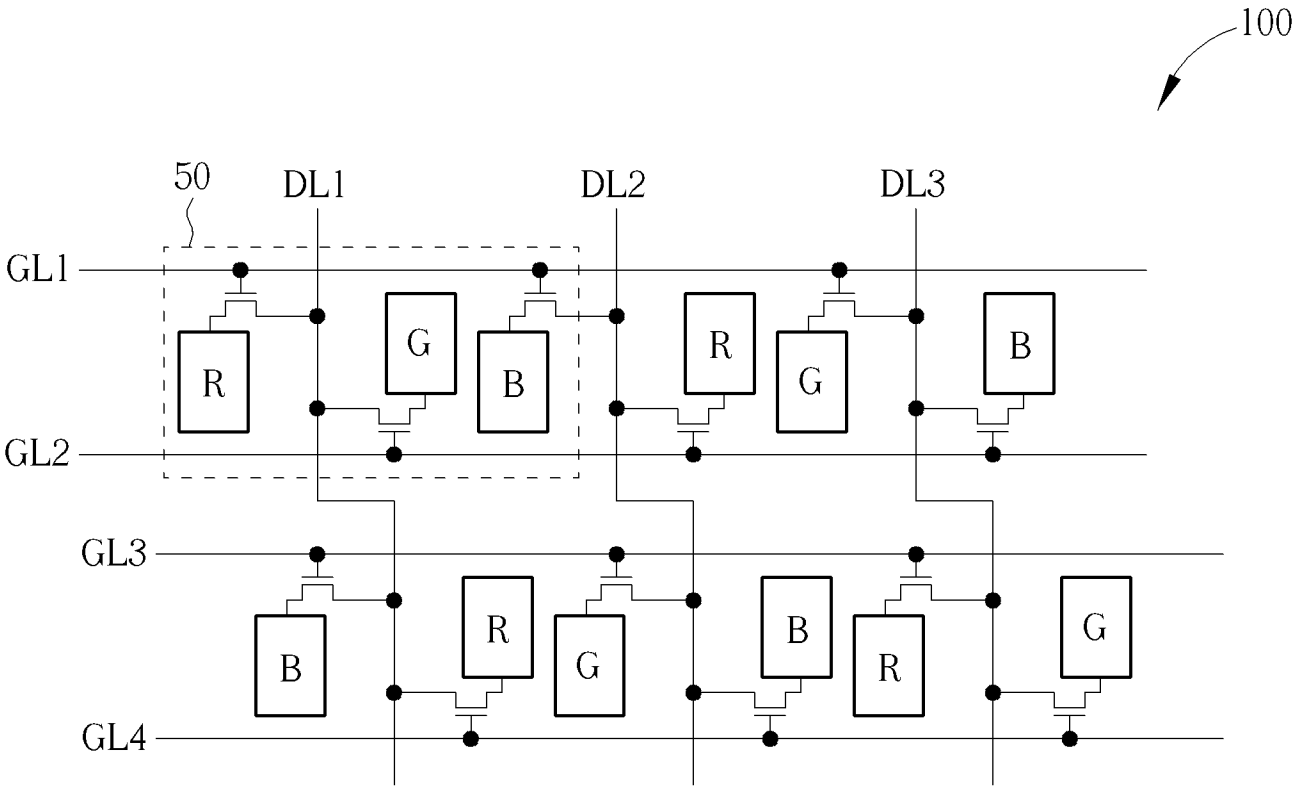
FIG. 1 PRIOR ART
FIG. 1 shows a related art display.
Figure 2:
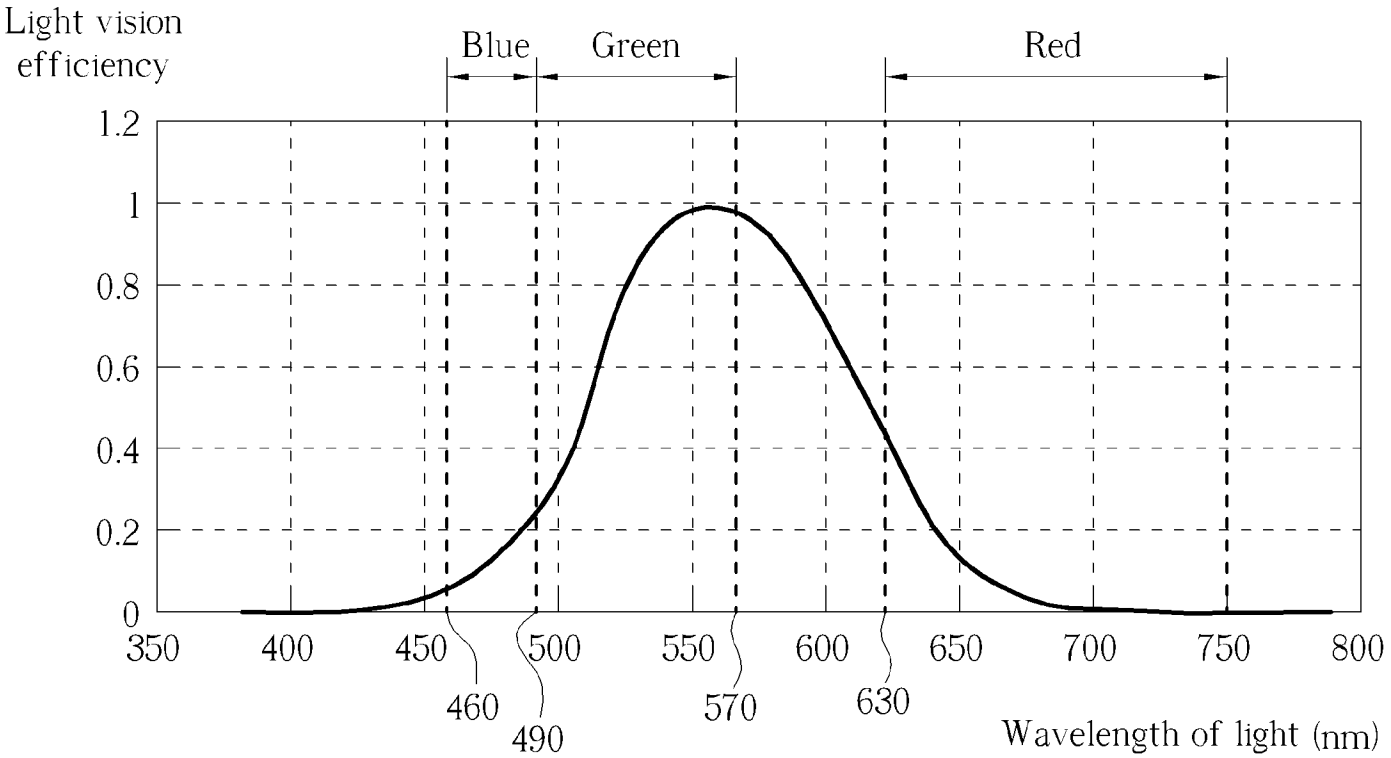
FIG. 2 PRIOR ART
FIG. 2 shows the waveform of light vision efficiency vs. the wavelength of light.

Through the configuration of the first embodiment, the second color sub-pixels G1, G2, G3 and G4 all become later charged sub-pixels, and the third color sub-pixels B1, B2, B3 and B4 all become first charged sub-pixels. Referring to FIG. 2, when the display 300 displays tricolor (red, green and blue colors) images, the green color which is the most sensitive color will not be affected thus the luminance of the green color will not be changed. That is, the display 300 not only halves the number of data lines, but also reduces the line mura effect caused by non-uniform luminance.

Figure 4:
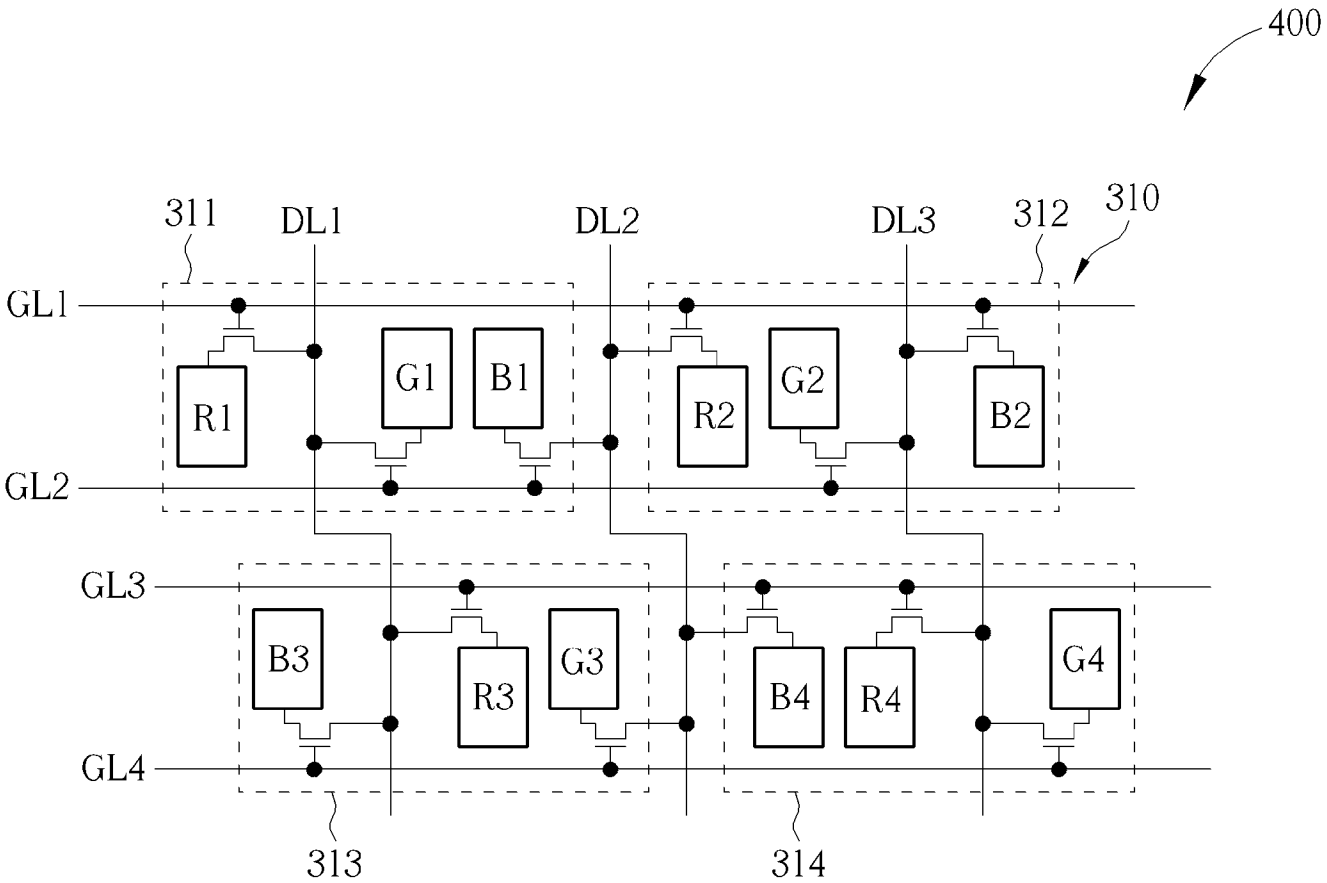
FIG. 4 shows a display according to the second embodiment of the present invention.

Please refer to FIG. 4, which shows a display 400 according to the second embodiment of the present invention. The difference between the first and second embodiments is that, in the second embodiment, the first color sub-pixel R1 of the first pixel 311, the first color sub-pixel R2 of the second pixel 312 and the third color sub-pixel B2 of the second pixel 312 are coupled to the first scan line GL1. The second color sub-pixel G1 of the first pixel 311, the third color sub-pixel B1 of the first pixel 311 and the second color sub-pixel G2 of the second pixel 312 are coupled to the second scan line GL2. The first color sub-pixel R3 of the third pixel 313, the first color sub-pixel R4 of the fourth pixel 314 and the third color sub-pixel B4 of the fourth pixel 314 are coupled to the third scan line GL3. The second color sub-pixel G3 of the third pixel 313, the third color sub-pixel B3 of the third pixel 313 and the second color sub-pixel G4 of the fourth pixel 314 are coupled to the fourth scan line GL4.

In the configuration of the second embodiment, the second color sub-pixels G1, G2, G3 and G4 are all later charged sub-pixels, and the first color sub-pixels R1, R2, R3 and R4 are all first charged sub-pixels. Thus, the display 400 not only halves the number of data lines, but also reduces the line mura effect caused by non-uniform luminance.

Figure 5:
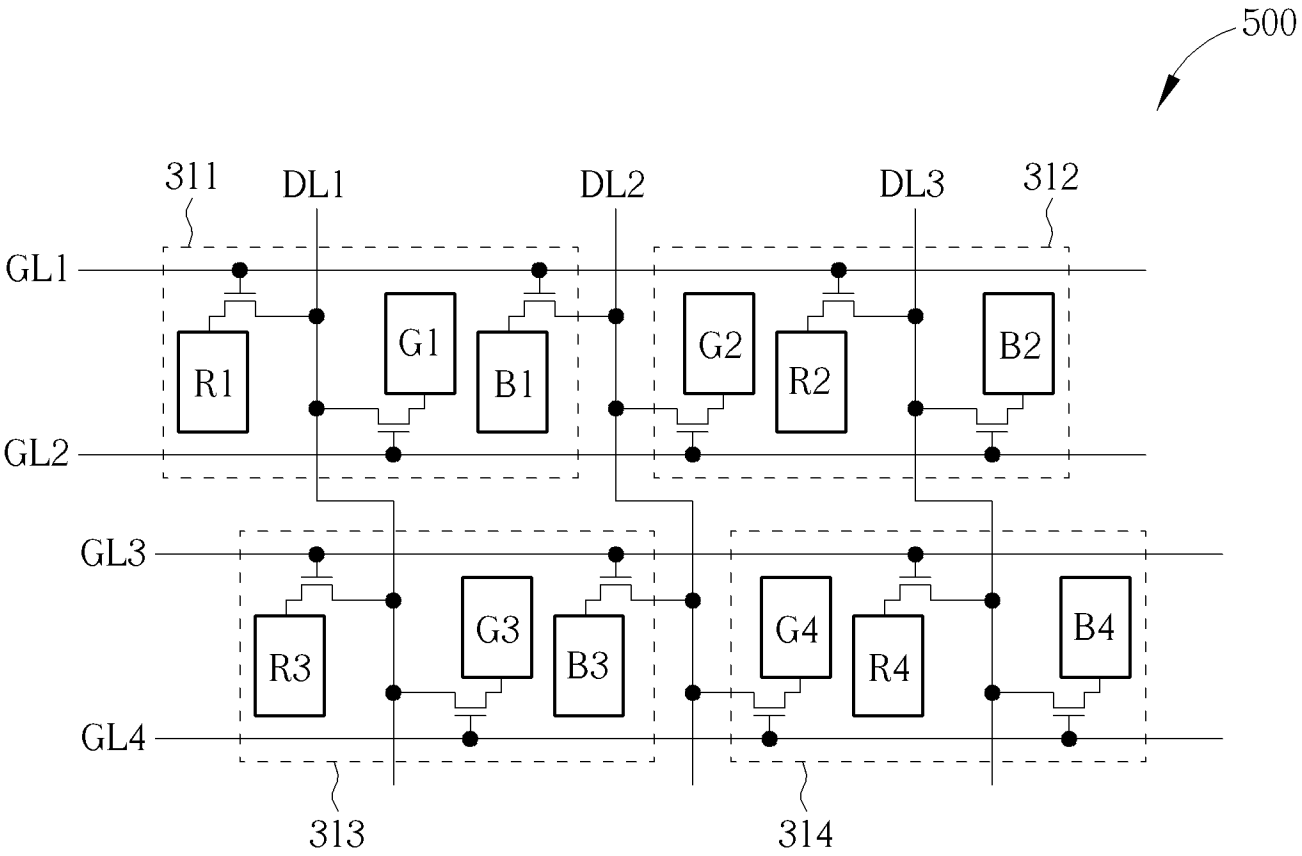
FIG. 5 shows a display according to the third embodiment of the present invention.

FIG. 5 shows a display 500 according to the third embodiment of the present invention. The first pixel 311 to the fourth pixel 314 in the third embodiment are configured to be different from those in the first and second embodiments. For example, in the first and second embodiments, a green sub-pixel might be configured to couple to an upper or a lower gate line, but the arrangement of all the sub-pixels such as "... R, G, B ..." will not be changed. However, the third embodiment will change the arrangement of all the sub-pixels such as "... R, G, B ...". The first pixel 311 to the fourth pixel 314 of the third embodiment are configured as follows:

The first color sub-pixel R1 of the first pixel 311 is coupled to the first scan line GL1 and the first data line DL1.

The second color sub-pixel G1 of the first pixel 311 is coupled to the second scan line GL2 and the first data line DL1.

The third color sub-pixel B1 of the first pixel 311 is coupled to the first scan line GL1 and the second data line DL2.

The first color sub-pixel R2 of the second pixel 312 is coupled to the first scan line GL1 and the third data line DL3.

The second color sub-pixel G2 of the second pixel 312 is coupled to the second scan line GL2 and the second data line DL2.

The third color sub-pixel B2 of the second pixel 312 is coupled to the second scan line GL2 and the third data line DL3.

The first color sub-pixel R3 of the third pixel 313 is coupled to the third scan line GL3 and the first data line DL1.

The second color sub-pixel G3 of the third pixel 313 is coupled to the fourth scan line GL4 and the first data line DL1.

The third color sub-pixel B3 of the third pixel 313 is coupled to the third scan line GL3 and the second data line DL2.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the second data line DL2.

The third color sub-pixel B4 of the fourth pixel 314 is coupled to the fourth scan line GL4 and the third data line DL3.

In the configuration of the third embodiment, the second color sub-pixels G1, G2, G3 and G4 are all later charged sub-pixels. Thus, the display 500 not only halves the number of data lines, but also reduces the line mura effect caused by non-uniform luminance.

The positions of the color sub-pixels in the first and second embodiments are the same, but the red and blue sub-pixels may be coupled to different scan lines. The positions of some of the color sub-pixels in the third embodiment are different from that of corresponding color sub-pixels in the first and second embodiments. However, adjacent color sub-pixels coupled to the same data line are sequentially coupled to different scan lines. The following fourth to tenth embodiments are based on the concepts of the first to third embodiments. The present invention is not limited to the first to tenth embodiments. Any equivalent configuration which is developed by modifying positions and/or scan line connections of color sub-pixels is within the scope of the present invention.

Figure 6:
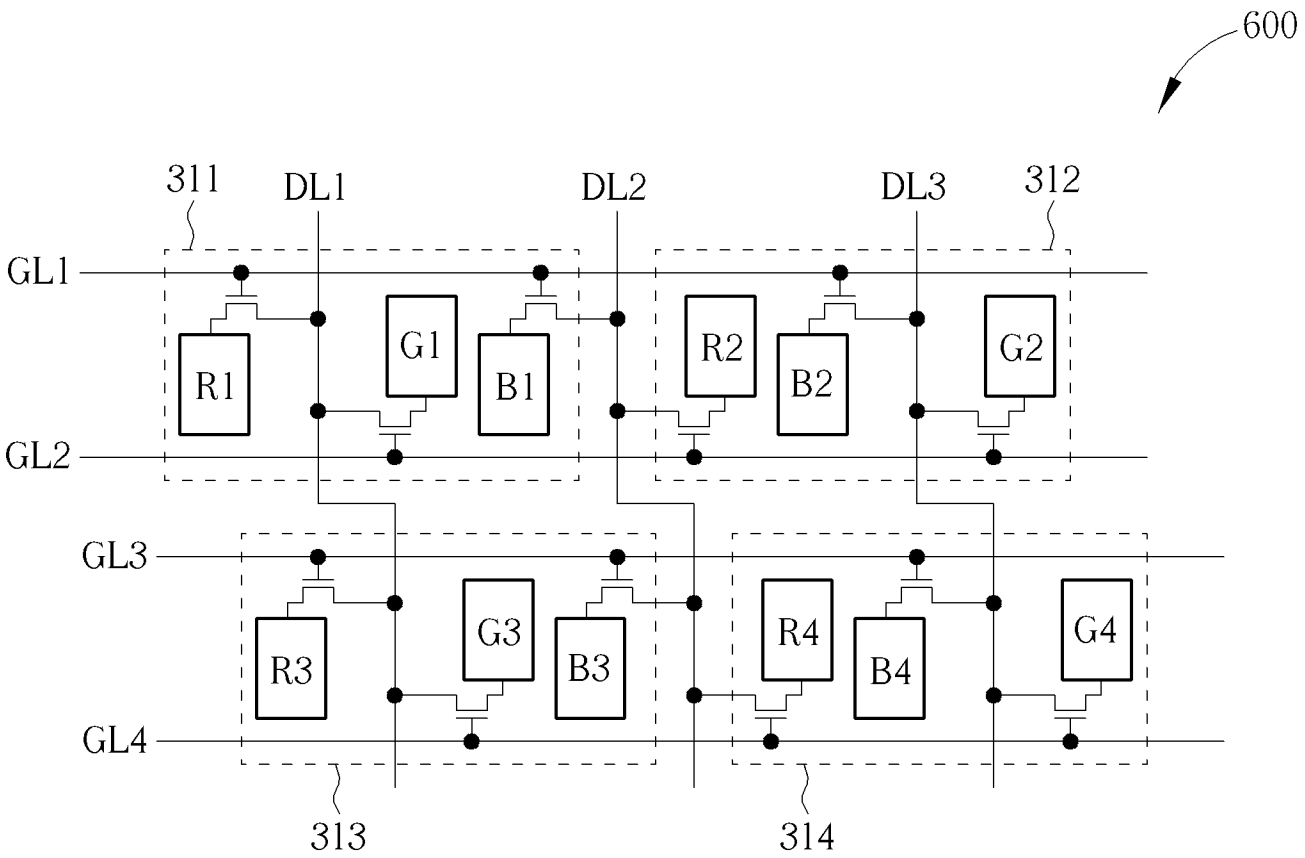
FIG. 6 shows a display according to the fourth embodiment of the present invention.

FIG. 6 shows a display 600 according to the fourth embodiment of the present invention. The first pixel 311 to the fourth pixel 314 in the fourth embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the fourth embodiment will change the arrangement of all the sub-pixels such as " . . . R, G, B . . . ". The first pixel 311 to the fourth pixel 314 of the fourth embodiment are configured as follows:

The first color sub-pixel R1 of the first pixel 311 is coupled to the first scan line GL1 and the first data line DL1.

The second color sub-pixel G1 of the first pixel 311 is coupled to the second scan line GL2 and the first data line DL1.

The third color sub-pixel B1 of the first pixel 311 is coupled to the first scan line GL1 and the second data line DL2.

The first color sub-pixel R2 of the second pixel 312 is coupled to the second scan line GL2 and the second data line DL2.

The second color sub-pixel G2 of the second pixel 312 is coupled to the second scan line GL2 and the third data line DL3.

The third color sub-pixel B2 of the second pixel 312 is coupled to the first scan line GL1 and the third data line DL3.

The first color sub-pixel R3 of the third pixel 313 is coupled to the third scan line GL3 and the first data line DL1.

The second color sub-pixel G3 of the third pixel 313 is coupled to the fourth scan line GL4 and the first data line DL1.

The third color sub-pixel B3 of the third pixel 313 is coupled to the third scan line GL3 and the second data line DL2.

The first color sub-pixel R4 of the fourth pixel 314 is coupled to the fourth scan line GL4 and the second data line DL2.

The second color sub-pixel G4 of the fourth pixel 314 is coupled to the fourth scan line GL4 and the third data line DL3.

The third color sub-pixel B4 of the fourth pixel 314 is coupled to the third scan line GL3 and the third data line DL3.

Similarly, in the configuration of the fourth embodiment, the second color sub-pixels G1, G2, G3 and G4 are all later charged sub-pixels. Thus, the display 600 not only halves the number of data lines, but also reduces the line mura effect caused by non-uniform luminance.

Figure 7:
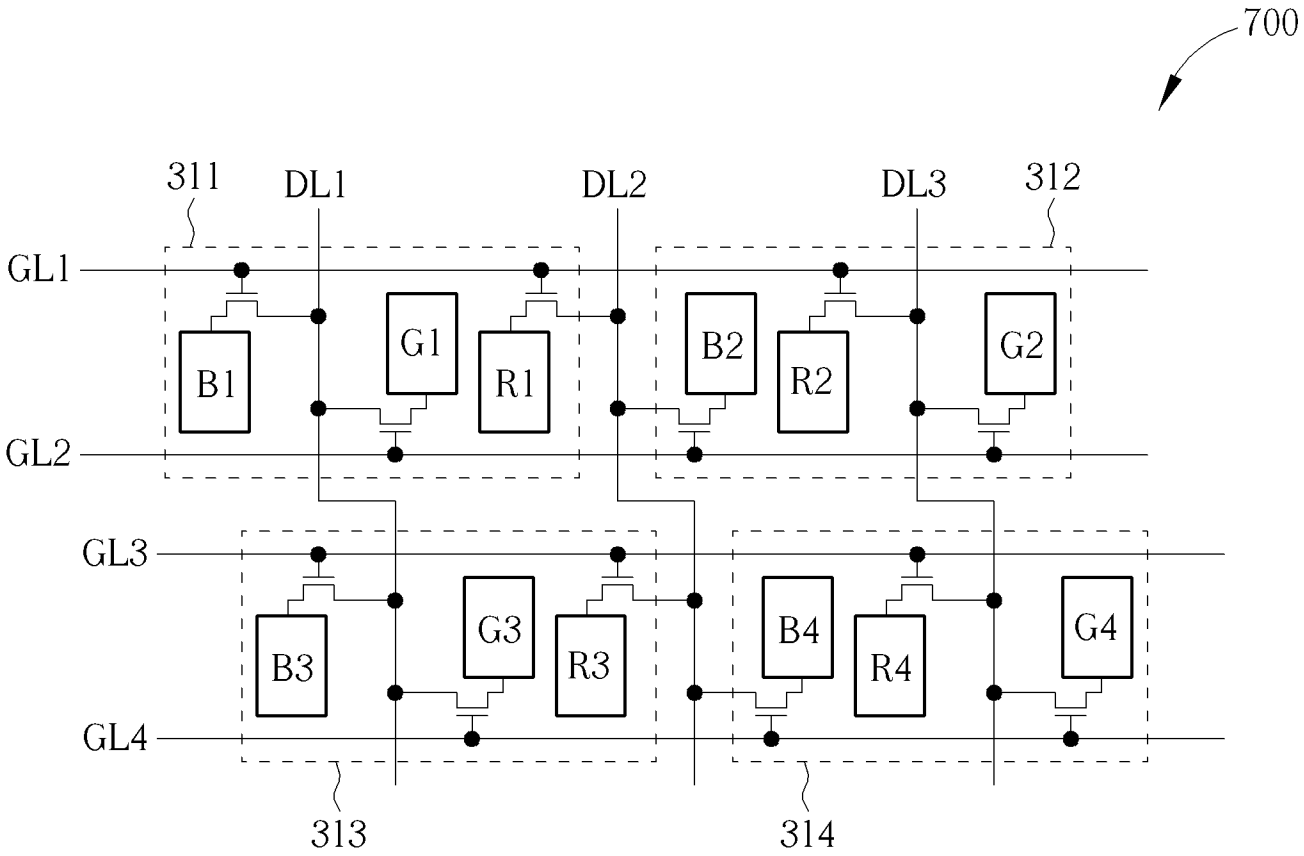
FIG. 7 shows a display according to the fifth embodiment of the present invention.

Please refer to FIG. 7, which shows a display 700 according to the fifth embodiment of the present invention. The first pixel 311 to the fourth pixel 314 in the fifth embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the fifth embodiment will change the arrangement of all the sub-pixels such as " . . . R, G, B . . . ". The first pixel 311 to the fourth pixel 314 of the fifth embodiment are configured as follows:

The first color sub-pixel R1 of the first pixel 311 is coupled to the first scan line GL1 and the second data line DL2.

The second color sub-pixel G1 of the first pixel 311 is coupled to the second scan line GL2 and the first data line DL1.

The third color sub-pixel B1 of the first pixel 311 is coupled to the first scan line GL1 and the first data line DL1.

The first color sub-pixel R2 of the second pixel 312 is coupled to the first scan line GL1 and the third data line DL3.

The second color sub-pixel G2 of the second pixel 312 is coupled to the second scan line GL2 and the third data line DL3.

The third color sub-pixel B2 of the second pixel 312 is coupled to the second scan line GL2 and the second data line DL2.

The first color sub-pixel R3 of the third pixel 313 is coupled to the third scan line GL3 and the second data line DL2.

The second color sub-pixel G3 of the third pixel 313 is coupled to the fourth scan line GL4 and the first data line DL1.

The third color sub-pixel B3 of the third pixel 313 is coupled to the third scan line GL3 and the first data line DL1.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the third data line DL3.

The third color sub-pixel B4 of the fourth pixel 314 is coupled to the fourth scan line GL4 and the second data line DL2.

Similarly, in the configuration of the fifth embodiment, the second color sub-pixels G1, G2, G3 and G4 are all later charged sub-pixels. Thus, the display 700 not only halves the number of data lines, but also reduces the line mura effect caused by non-uniform luminance.

Figure 8:
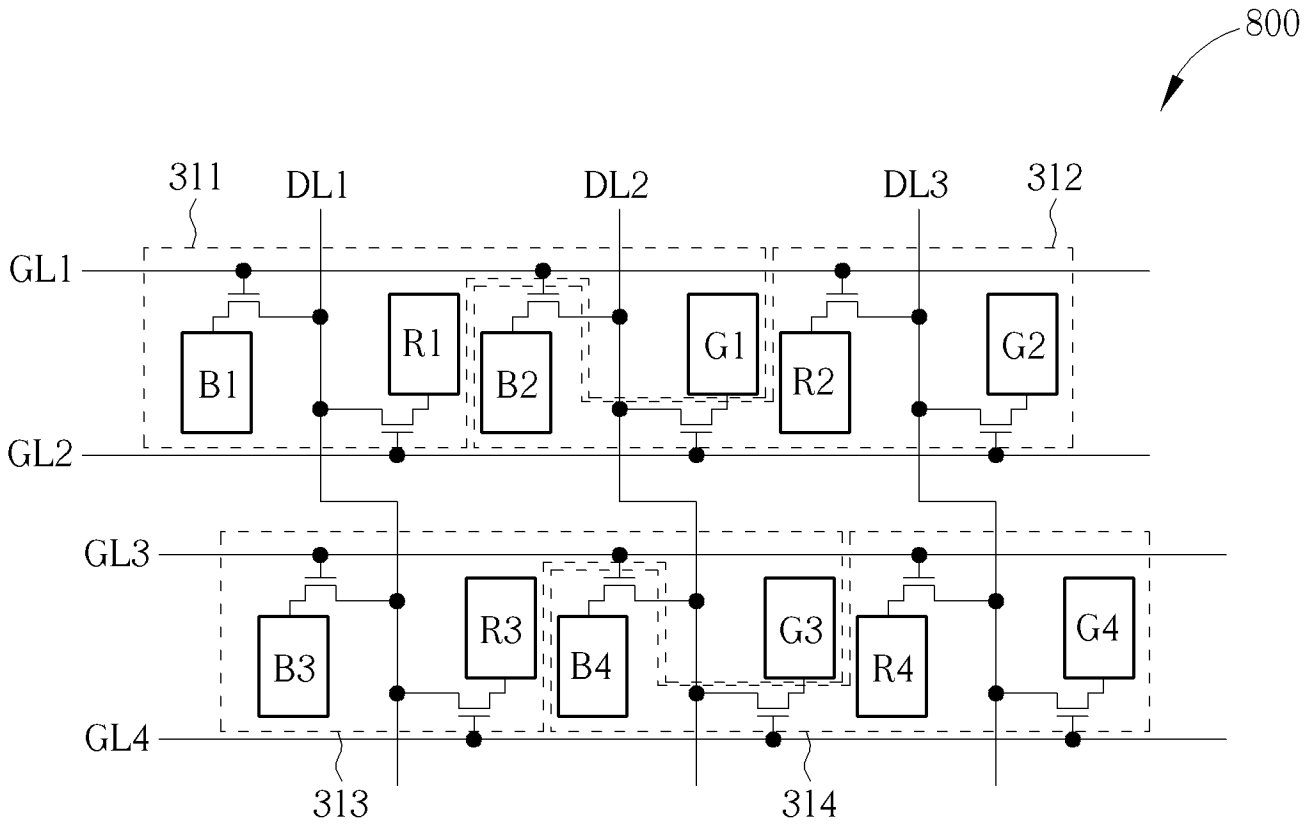
FIG. 8 shows a display according to the sixth embodiment of the present invention.

Please refer to FIG. 8, which shows a display 800 according to the sixth embodiment of the present invention. The first pixel 311 to the fourth pixel 314 in the sixth embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the sixth embodiment will change the arrangement of all the sub-pixels such as " . . . R, G, B . . . ". The first pixel 311 to the fourth pixel 314 of the sixth embodiment are configured as follows:

The first color sub-pixel R1 of the first pixel 311 is coupled to the second scan line GL2 and the first data line DL1.

The second color sub-pixel G1 of the first pixel 311 is coupled to the second scan line GL2 and the second data line DL2.

The third color sub-pixel B1 of the first pixel 311 is coupled to the first scan line GL1 and the first data line DL1.

The first color sub-pixel R2 of the second pixel 312 is coupled to the first scan line GL1 and the third data line DL3.

The second color sub-pixel G2 of the second pixel 312 is coupled to the second scan line GL2 and the third data line DL3.

The third color sub-pixel B2 of the second pixel 312 is coupled to the first scan line GL1 and the second data line DL2.

The first color sub-pixel R3 of the third pixel 313 is coupled to the fourth scan line GL4 and the first data line DL1.

The second color sub-pixel G3 of the third pixel 313 is coupled to the fourth scan line GL4 and the second data line DL2.

The third color sub-pixel B3 of the third pixel 313 is coupled to the third scan line GL3 and the first data line DL1.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the third data line DL3.

The third color sub-pixel B4 of the fourth pixel 314 is coupled to the third scan line GL3 and the second data line DL2.

Similarly, in the configuration of the sixth embodiment, the second color sub-pixels G1, G2, G3 and G4 are all later charged sub-pixels. Thus, the display 800 not only halves the number of data lines, but also reduces the line mura effect caused by non-uniform luminance.

Figure 9:
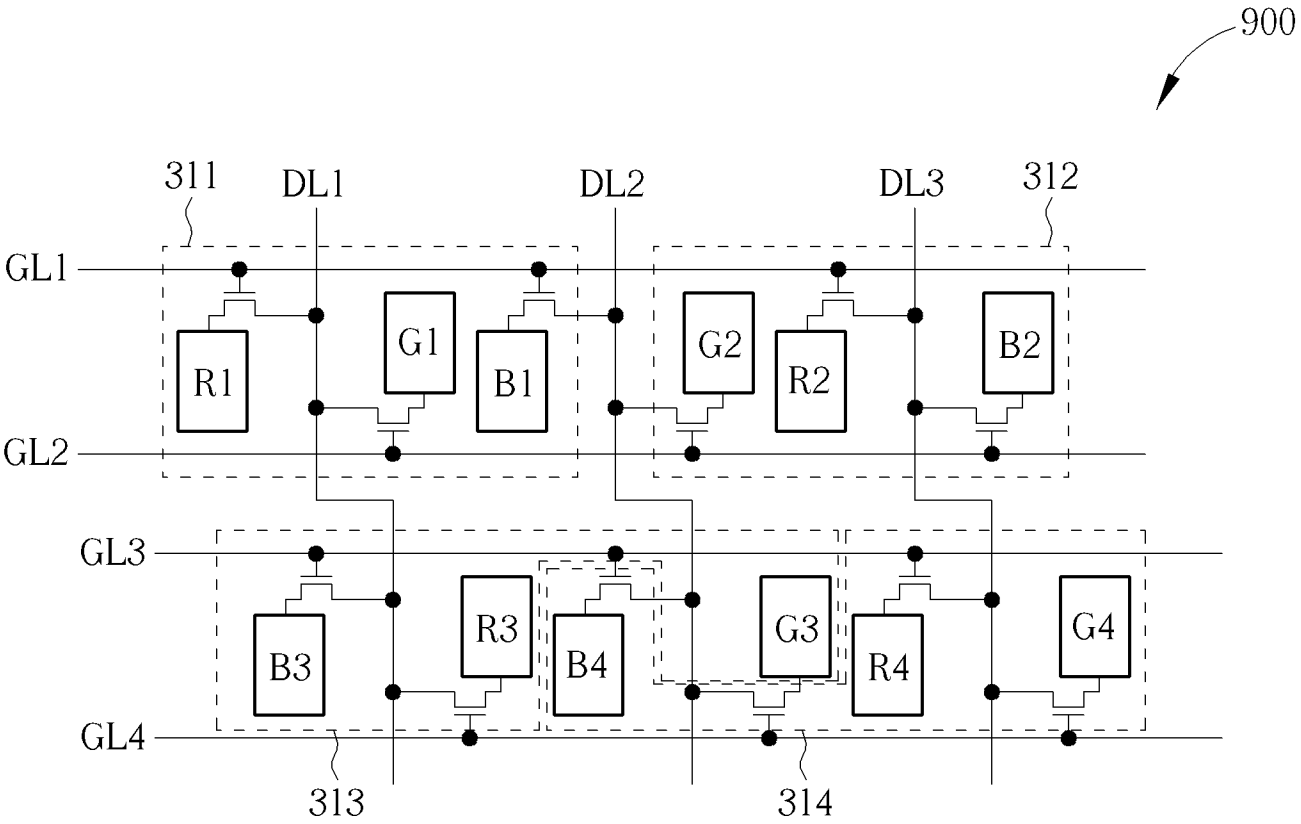
FIG. 9 shows a display according to the seventh embodiment of the present invention.

Please refer to FIG. 9, which shows a display 900 according to the seventh embodiment of the present invention. The first pixel 311 to the fourth pixel 314 in the seventh embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the seventh embodiment will change the arrangement of all the sub-pixels such as " . . . R, G, B . . . ". The first pixel 311 to the fourth pixel 314 of the seventh embodiment are configured as follows:

The first color sub-pixel R1 of the first pixel 311 is coupled to the first scan line GL1 and the first data line DL1.

The second color sub-pixel G1 of the first pixel 311 is coupled to the second scan line GL2 and the first data line DL1.

The third color sub-pixel B1 of the first pixel 311 is coupled to the first scan line GL1 and the second data line DL2.

The first color sub-pixel R2 of the second pixel 312 is coupled to the first scan line GL1 and the third data line DL3.

The second color sub-pixel G2 of the second pixel 312 is coupled to the second scan line GL2 and the second data line DL2.

The third color sub-pixel B2 of the second pixel 312 is coupled to the second scan line GL2 and the third data line DL3.

The first color sub-pixel R3 of the third pixel 313 is coupled to the fourth scan line GL4 and the first data line DL1.

The second color sub-pixel G3 of the third pixel 313 is coupled to the fourth scan line GL4 and the second data line DL2.

The third color sub-pixel B3 of the third pixel 313 is coupled to the third scan line GL3 and the first data line DL1.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the third data line DL3.

The third color sub-pixel B4 of the fourth pixel 314 is coupled to the third scan line GL3 and the second data line DL2.

Similarly, in the configuration of the seventh embodiment, the second color sub-pixels G1, G2, G3 and G4 are all later charged sub-pixels. Thus, the display 900 not only halves the number of data lines, but also reduces the line mura effect caused by non-uniform luminance.

Figure 10:
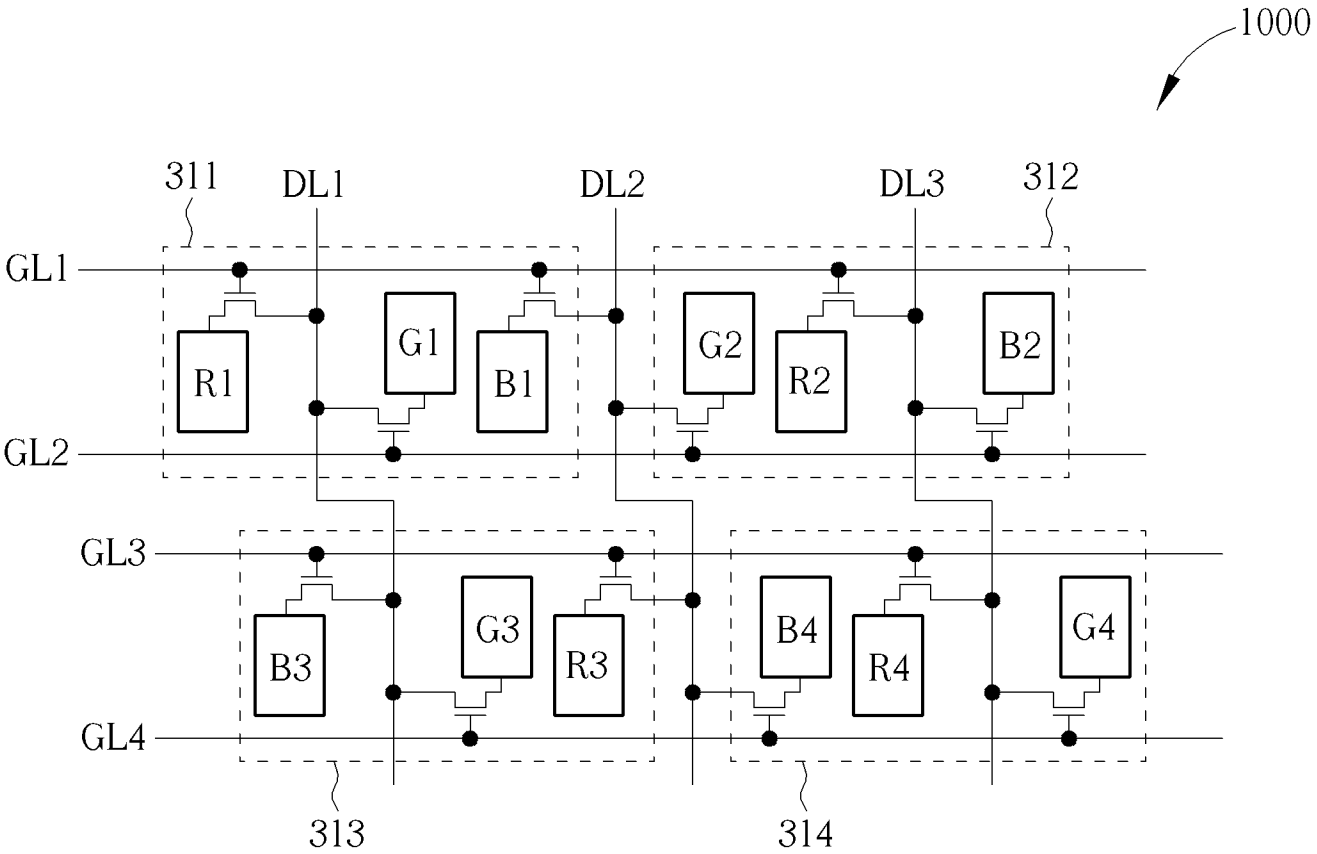
FIG. 10 shows a display according to the eighth embodiment of the present invention.

Please refer to FIG. 10, which shows a display 1000 according to the eighth embodiment of the present invention. The first pixel 311 to the fourth pixel 314 in the eighth embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the eighth embodiment will change the arrangement of all the sub-pixels such as " . . . R, G, B . . . ". The first pixel 311 to the fourth pixel 314 of the eighth embodiment are configured as follows:

The first color sub-pixel R1 of the first pixel 311 is coupled to the first scan line GL1 and the first data line DL1.

The second color sub-pixel G1 of the first pixel 311 is coupled to the second scan line GL2 and the first data line DL1.

The third color sub-pixel B1 of the first pixel 311 is coupled to the first scan line GL1 and the second data line DL2.

The first color sub-pixel R2 of the second pixel 312 is coupled to the first scan line GL1 and the third data line DL3.

The second color sub-pixel G2 of the second pixel 312 is coupled to the second scan line GL2 and the second data line DL2.

The third color sub-pixel B2 of the second pixel 312 is coupled to the second scan line GL2 and the third data line DL3.

The first color sub-pixel R3 of the third pixel 313 is coupled to the third scan line GL3 and the second data line DL2.

The second color sub-pixel G3 of the third pixel 313 is coupled to the fourth scan line GL4 and the first data line DL1.

The third color sub-pixel B3 of the third pixel 313 is coupled to the third scan line GL3 and the first data line DL1.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the third data line DL3.

The third color sub-pixel B4 of the fourth pixel 314 is coupled to the fourth scan line GL4 and the second data line DL2.

Similarly, in the configuration of the eighth embodiment, the second color sub-pixels G1, G2, G3 and G4 are all later charged sub-pixels. Thus, the display 1000 not only halves the number of data lines, but also reduces the line mura effect caused by non-uniform luminance.

Figure 11:
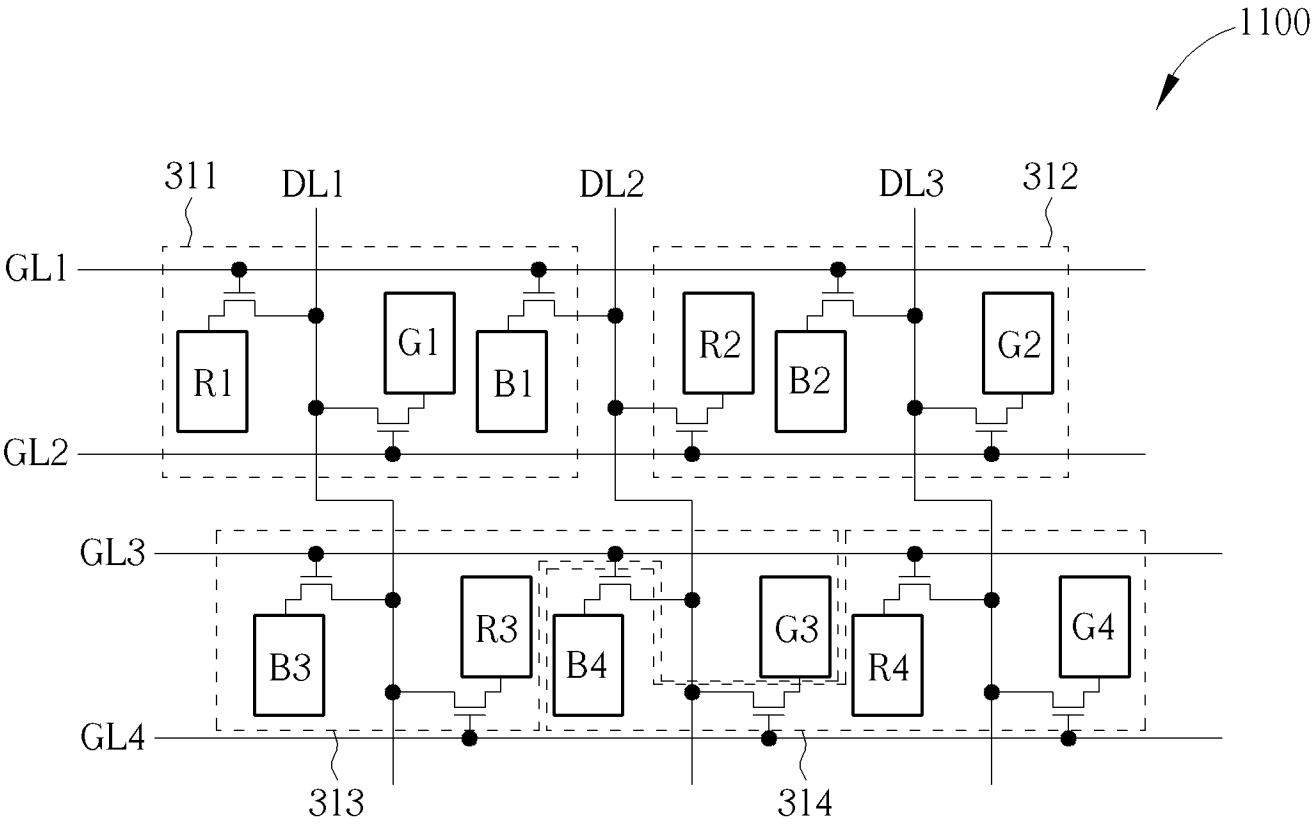
FIG. 11 shows a display according to the ninth embodiment of the present invention.

Please refer to FIG. 11, which shows a display 1100 according to the ninth embodiment of the present invention. The first pixel 311 to the fourth pixel 314 in the ninth embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the ninth embodiment will change the arrangement of all the sub-pixels such as " . . . R, G, B . . . ". The first pixel 311 to the fourth pixel 314 of the ninth embodiment are configured as follows:

The first color sub-pixel R1 of the first pixel 311 is coupled to the first scan line GL1 and the first data line DL1.

The second color sub-pixel G1 of the first pixel 311 is coupled to the second scan line GL2 and the first data line DL1.

The third color sub-pixel B1 of the first pixel 311 is coupled to the first scan line GL1 and the second data line DL2.

The first color sub-pixel R2 of the second pixel 312 is coupled to the second scan line GL2 and the second data line DL2.

The second color sub-pixel G2 of the second pixel 312 is coupled to the second scan line GL2 and the third data line DL3.

The third color sub-pixel B2 of the second pixel 312 is coupled to the first scan line GL1 and the third data line DL3.

The first color sub-pixel R3 of the third pixel 313 is coupled to the fourth scan line GL4 and the first data line DL1.

The second color sub-pixel G3 of the third pixel 313 is coupled to the fourth scan line GL4 and the second data line DL2.

The third color sub-pixel B3 of the third pixel 313 is coupled to the third scan line GL3 and the first data line DL1.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the third data line DL3.

The third color sub-pixel B4 of the fourth pixel 314 is coupled to the third scan line GL3 and the second data line DL2.

Similarly, in the configuration of the ninth embodiment, the second color sub-pixels G1, G2, G3 and G4 are all later charged sub-pixels. Thus, the display 1100 not only halves the number of data lines, but also reduces the line mura effect caused by non-uniform luminance.

Figure 12:
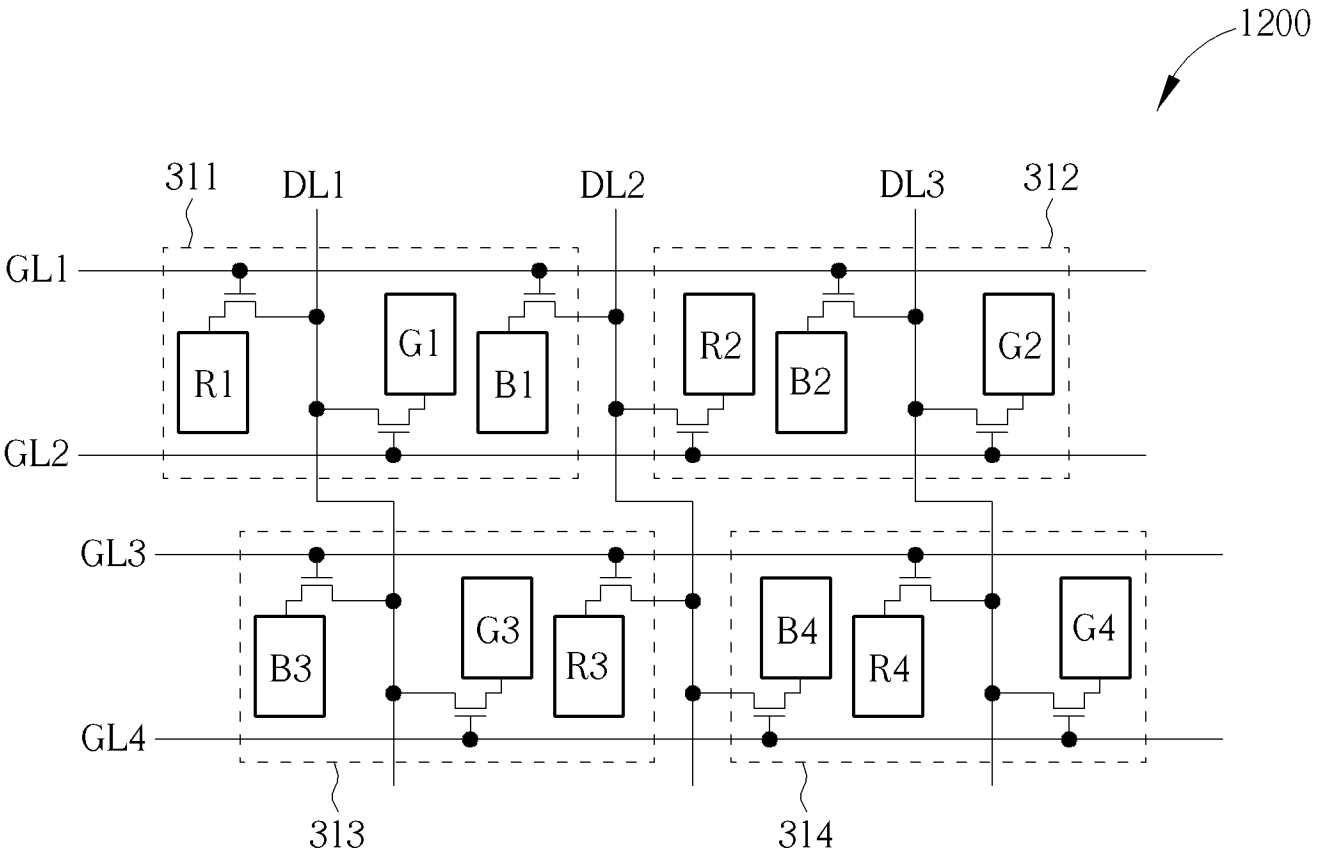
FIG. 12 shows a display according to the tenth embodiment of the present invention.

Please refer to FIG. 12, which shows a display 1200 according to the tenth embodiment of the present invention. The first pixel 311 to the fourth pixel 314 in the tenth embodiment are configured to be different from those in the first and second embodiments. For example, in the first and second embodiments, a green sub-pixel might be configured to couple to an upper or a lower gate line, but the arrangement of all the sub-pixels such as " . . . R, G, B . . . " will not be changed. However, the tenth embodiment will change the arrangement of all the sub-pixels such as " . . . R, G, B . . . ". The first pixel 311 to the fourth pixel 314 of the tenth embodiment are configured as follows:

The first color sub-pixel R1 of the first pixel 311 is coupled to the first scan line GL1 and the first data line DL1.

The second color sub-pixel G1 of the first pixel 311 is coupled to the second scan line GL2 and the first data line DL1.

The third color sub-pixel B1 of the first pixel 311 is coupled to the first scan line GL1 and the second data line DL2.

The first color sub-pixel R2 of the second pixel 312 is coupled to the second scan line GL2 and the second data line DL2.

The second color sub-pixel G2 of the second pixel 312 is coupled to the second scan line GL2 and the third data line DL3.

The third color sub-pixel B2 of the second pixel 312 is coupled to the first scan line GL1 and the third data line DL3.

The first color sub-pixel R3 of the third pixel 313 is coupled to the third scan line GL3 and the second data line DL2.

The second color sub-pixel G3 of the third pixel 313 is coupled to the fourth scan line GL4 and the first data line DL1.

The third color sub-pixel B3 of the third pixel 313 is coupled to the third scan line GL3 and the first data line DL1.

The first color sub-pixel R4 of the fourth pixel 314 is coupled to the third scan line GL3 and the third data line DL3.

The second color sub-pixel G4 of the fourth pixel 314 is coupled to the fourth scan line GL4 and the third data line DL3.

The third color sub-pixel B4 of the fourth pixel 314 is coupled to the fourth scan line GL4 and the second data line DL2.

Similarly, in the configuration of the tenth embodiment, the second color sub-pixels G1, G2, G3 and G4 are all later charged sub-pixels. Thus, the display 1200 not only halves the number of data lines, but also reduces the line mura effect caused by non-uniform luminance.

Another embodiment of the present invention relates to a method for driving a display. The display comprises a plurality of pixels, a plurality of scan lines and a plurality of data lines. Each of the pixels comprises a first color sub-pixel, a second color sub-pixel and a third color sub-pixel. Every two color sub-pixels in a same row coupled to a same data line have different colors. The driving method comprises driving first color sub-pixels R1, R2, R3 and R4 and third color sub-pixels B1, B2, B3 and B4 in the same row, and driving second color sub-pixels G1, G2, G3 and G4 in the same row after driving the first color sub-pixels R1, R2, R3 and R4 and the third color sub-pixels B1, B2, B3 and B4 in the same row.

In view of above, through the configurations of the first to tenth embodiments, the second color sub-pixels G1, G2, G3 and G4 all become later charged sub-pixels. Thus, the green color which is the most sensitive color will not be affected by other colors. That is, the displays 300 to 1200 not only halve the number of data lines, but also reduce the line mura effect caused by non-uniform luminance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display, comprising:

a plurality of pixels, comprising a first pixel, a second pixel, a third pixel and a fourth pixel, the first pixel and the second pixel are in a first row, the third pixel and the fourth pixel are in a second row, each of the pixels comprising a first color sub-pixel, a second color sub-pixel and a third color sub-pixel;

a plurality of scan lines coupled to the plurality of pixels, comprising a first scan line, a second scan line, a third scan line and a fourth scan line; and a plurality of data lines coupled to the plurality of pixels, comprising a first data line, a second data line and a third data line;

wherein:

the first color sub-pixel and the second color sub-pixel of the first pixel are coupled to the first data line;

the third color sub-pixel of the first pixel and the first color sub-pixel of the second pixel are coupled to the second data line;

the second color sub-pixel of the second pixel and the third color sub-pixel of the second pixel are coupled to the third data line;

the third color sub-pixel of the third pixel and the first color sub-pixel of the third pixel are coupled to the first data line;

the second color sub-pixel of the third pixel and the third color sub-pixel of the fourth pixel are coupled to the second data line;

the first color sub-pixel of the fourth pixel and the second color sub-pixel of the fourth pixel are coupled to the third data line;

each second color sub-pixel of the first row is directly connected to the second scan line;

each second color sub-pixel of the second row is directly connected to the fourth scan line; and the first color sub-pixel is a red color sub-pixel, the second color sub-pixel is a green color sub-pixel, and a third color sub-pixel is a blue color sub-pixel.

2. The display of claim 1, wherein the first scan line, the second scan line, the third scan line and the fourth scan line are arranged in sequence, and the first data line, the second data line and the third data line are arranged in sequence.

3. The display of claim 2, wherein:

a first color sub-pixel of the first pixel is coupled to the first scan line and the first data line;

a second color sub-pixel of the first pixel is coupled to the second scan line and the first data line;

a third color sub-pixel of the first pixel is coupled to the first scan line and the second data line;

a first color sub-pixel of the second pixel is coupled to the first scan line and the third data line;

a second color sub-pixel of the second pixel is coupled to the second scan line and the second data line; and a third color sub-pixel of the second pixel is coupled to the second scan line and the third data line.

4. The display of claim 3, wherein:

a first color sub-pixel of the third pixel is coupled to the third scan line and the first data line;

a second color sub-pixel of the third pixel is coupled to the fourth scan line and the first data line;

a third color sub-pixel of the third pixel is coupled to the third scan line and the second data line;

a first color sub-pixel of the fourth pixel is coupled to the third scan line and the third data line;

a second color sub-pixel of the fourth pixel is coupled to the fourth scan line and the second data line; and a third color sub-pixel of the fourth pixel is coupled to the fourth scan line and the third data line.

5. The display of claim 3, wherein:

a first color sub-pixel of the third pixel is coupled to the fourth scan line and the first data line;

a second color sub-pixel of the third pixel is coupled to the fourth scan line and the second data line;

a third color sub-pixel of the third pixel is coupled to the third scan line and the first data line;

a first color sub-pixel of the fourth pixel is coupled to the third scan line and the third data line;

a second color sub-pixel of the fourth pixel is coupled to the fourth scan line and the third data line; and a third color sub-pixel of the fourth pixel is coupled to the third scan line and the second data line.

6. The display of claim 3, wherein:

a first color sub-pixel of the third pixel is coupled to the third scan line and the second data line;

a second color sub-pixel of the third pixel is coupled to the fourth scan line and the first data line;

a third color sub-pixel of the third pixel is coupled to the third scan line and the first data line;

a first color sub-pixel of the fourth pixel is coupled to the third scan line and the third data line;

a second color sub-pixel of the fourth pixel is coupled to the fourth scan line and the third data line; and a third color sub-pixel of the fourth pixel is coupled to the fourth scan line and the second data line.

7. The display of claim 2, wherein:

a first color sub-pixel of the first pixel is coupled to the first scan line and the first data line;

a second color sub-pixel of the first pixel is coupled to the second scan line and the first data line;

a third color sub-pixel of the first pixel is coupled to the first scan line and the second data line;

a first color sub-pixel of the second pixel is coupled to the second scan line and the second data line;

a second color sub-pixel of the second pixel is coupled to the second scan line and the third data line; and a third color sub-pixel of the second pixel is coupled to the first scan line and the third data line.

8. The display of claim 7, wherein:

a first color sub-pixel of the third pixel is coupled to the third scan line and the first data line;

a second color sub-pixel of the third pixel is coupled to the fourth scan line and the first data line;

a third color sub-pixel of the third pixel is coupled to the third scan line and the second data line;

a first color sub-pixel of the fourth pixel is coupled to the fourth scan line and the second data line;

a second color sub-pixel of the fourth pixel is coupled to the fourth scan line and the third data line; and a third color sub-pixel of the fourth pixel is coupled to the third scan line and the third data line.

9. The display of claim 7, wherein:

a first color sub-pixel of the third pixel is coupled to the fourth scan line and the first data line;

a second color sub-pixel of the third pixel is coupled to the fourth scan line and the second data line;

a third color sub-pixel of the third pixel is coupled to the third scan line and the first data line;

a first color sub-pixel of the fourth pixel is coupled to the third scan line and the third data line;

a second color sub-pixel of the fourth pixel is coupled to the fourth scan line and the third data line; and a third color sub-pixel of the fourth pixel is coupled to the third scan line and the second data line.

10. The display of claim 7, wherein:

a first color sub-pixel of the third pixel is coupled to the third scan line and the second data line;

a second color sub-pixel of the third pixel is coupled to the fourth scan line and the first data line;

a third color sub-pixel of the third pixel is coupled to the third scan line and the first data line;

a first color sub-pixel of the fourth pixel is coupled to the third scan line and the third data line;

a second color sub-pixel of the fourth pixel is coupled to the fourth scan line and the third data line; and a third color sub-pixel of the fourth pixel is coupled to the fourth scan line and the second data line.

11. The display of claim 2, wherein:

a first color sub-pixel of the first pixel is coupled to the first scan line and the second data line;

a second color sub-pixel of the first pixel is coupled to the second scan line and the first data line;

a third color sub-pixel of the first pixel is coupled to the first scan line and the first data line;

a first color sub-pixel of the second pixel is coupled to the first scan line and the third data line;

a second color sub-pixel of the second pixel is coupled to the second scan line and the third data line;

a third color sub-pixel of the second pixel is coupled to the second scan line and the second data line;

a first color sub-pixel of the third pixel is coupled to the third scan line and the second data line;

a second color sub-pixel of the third pixel is coupled to the fourth scan line and the first data line;

a third color sub-pixel of the third pixel is coupled to the third scan line and the first data line;

a first color sub-pixel of the fourth pixel is coupled to the third scan line and the third data line;

a second color sub-pixel of the fourth pixel is coupled to the fourth scan line and the third data line; and a third color sub-pixel of the fourth pixel is coupled to the fourth scan line and the second data line.

12. The display of claim 2, wherein:

a first color sub-pixel of the first pixel is coupled to the second scan line and the first data line;

a second color sub-pixel of the first pixel is coupled to the second scan line and the second data line;

a third color sub-pixel of the first pixel is coupled to the first scan line and the first data line;

a first color sub-pixel of the second pixel is coupled to the first scan line and the third data line;

a second color sub-pixel of the second pixel is coupled to the second scan line and the third data line;

a third color sub-pixel of the second pixel is coupled to the first scan line and the second data line;

a first color sub-pixel of the third pixel is coupled to the fourth scan line and the first data line;

a second color sub-pixel of the third pixel is coupled to the fourth scan line and the second data line;

a third color sub-pixel of the third pixel is coupled to the third scan line and the first data line;

a first color sub-pixel of the fourth pixel is coupled to the third scan line and the third data line;

a second color sub-pixel of the fourth pixel is coupled to the fourth scan line and the third data line; and a third color sub-pixel of the fourth pixel is coupled to the third scan line and the second data line.

13. The display of claim 1, wherein:

the first color sub-pixel of the first pixel, the third color sub-pixel of the first pixel and the third color sub-pixel of the second pixel are coupled to the first scan line; and the second color sub-pixel of the first pixel, the first color sub-pixel of the second pixel and the second color sub-pixel of the second pixel are coupled to the second scan line.

14. The display of claim 13, wherein:

the third color sub-pixel of the third pixel, the first color sub-pixel of the fourth pixel and the third color sub-pixel of the fourth pixel are coupled to the third scan line; and the first color sub-pixel of the third pixel, the second color sub-pixel of the third pixel and the second color sub-pixel of the fourth pixel are coupled to the fourth scan line.

15. A method for driving a display, the display comprising a plurality of pixels, a plurality of scan lines and a plurality of data lines, each of the pixels comprising a first color sub-pixel, a second color sub-pixel and a third color sub-pixel, every two color sub-pixels in a same row coupled to a same data line having different colors, the method comprising:

driving first color sub-pixels and third color sub-pixels in the same row; and driving second color sub-pixels in the same row after driving the first color sub-pixels and the third color sub-pixels in the same row;

wherein the second color sub-pixels are green sub-pixels.

16. The method of claim 15, wherein every two color sub-pixels in the same row coupled to the same data line are coupled to different scan lines.

* * * * *